US006928178B2

(12) United States Patent
Chang

(10) Patent No.: US 6,928,178 B2
(45) Date of Patent: Aug. 9, 2005

(54) CONDENSER MICROPHONE AND METHOD FOR MAKING THE SAME

(75) Inventor: Chao-Chih Chang, Taichung (TW)

(73) Assignee: Taiwan Carol Electronics Co., Ltd., Taichung (TW)

( * ) Notice: Subject to any disclaimer, the term of this patent is extended or adjusted under 35 U.S.C. 154(b) by 294 days.

(21) Appl. No.: 10/321,073

(22) Filed: Dec. 17, 2002

(65) Prior Publication Data

US 2004/0114775 A1 Jun. 17, 2004

(51) Int. Cl.[7] ..... H04R 25/00

(52) U.S. Cl. ..... 381/191; 381/355; 381/396; 29/594

(58) Field of Search ..... 381/170–176, 381/355, 369, 191, 396; 367/172–174, 181, 188; 29/594

(56) References Cited

U.S. PATENT DOCUMENTS 6,667,189 B1 * 12/2003 Wang et al. ..... 438/53
6,741,709 B2 * 5/2004 Kay et al. ..... 381/175
6,806,593 B2 * 10/2004 Tai et al. ..... 307/400

* cited by examiner

*Primary Examiner*—Suhan Ni
(74) *Attorney, Agent, or Firm*—Ladas & Parry LLP

(57) ABSTRACT

A condenser microphone includes a housing having a bottom wall that is formed with a recess which is defined by a recess-defining wall. A condenser is disposed in the housing, defines a variable gap chamber, and covers the recess. The condenser includes a back plate that is in the form of a metal plate which is formed with a plurality of through-holes and which cooperates with the recess-defining wall to define a closed air chamber in fluid communication with the gap chamber through the through-holes.

12 Claims, 5 Drawing Sheets

CONDENSER MICROPHONE AND METHOD FOR MAKING THE SAME

BACKGROUND OF THE INVENTION

1. Field of the Invention

This invention relates to a condenser microphone, more particular to a condenser microphone that is formed with a variable gap chamber in a condenser and a closed air chamber between the condenser and a condenser housing and to a method for making the same.

2. Description of the Related Art

FIG. 1 illustrates a conventional condenser microphone 200 disclosed in U.S. Pat. No. 6,243,474. The condenser microphone 200, which is formed by micro-machining technology, includes a microphone membrane unit 2 and a microphone back plate 2'. The microphone membrane unit 2 includes a supporting frame 20, a silicon nitride membrane 21 formed on the supporting frame 20, and a PTFE (polytetrafluoroethylene) electret 23 formed on the silicon nitride membrane 21. The microphone back plate 2' includes a silicon substrate 24, an insulating layer 22 formed on the silicon substrate 24, and a back plate electrode 26 formed on the insulating layer 22. A plurality of cavities 28 are formed in the silicon substrate 24 and are exposed from the insulating layer 22 and the back plate electrode 26 for reducing air stream resistance during microphone operation.

The conventional condenser microphone is disadvantageous in that formation of the cavities 28 involves patterning and etching processes, and is thus time-consuming and expensive. Since each cavity 28 requires a sufficient depth to effectively reduce the air stream resistance, the thickness of the microphone back plate 2' is relatively thick. As a consequence, minimization of the size of the condenser microphone 200 is undesirably limited. In addition, attachment of the condenser microphone 200 to a circuit board of an electronic device (not shown) cannot be done by using surface mount techniques (SMT) due to the property of the PTFE electret 23, which is workable at a temperature less than 240° C. Thus, mass production of the aforesaid electronic device is not feasible.

The disclosure of U.S. Pat. No. 6,243,474 is incorporated herein by reference.

SUMMARY OF THE INVENTION

Therefore, the object of the present invention is to provide a condenser microphone that is capable of overcoming the aforementioned drawbacks of the prior art.

Another object of the present invention is to provide a method for making the condenser microphone of this invention.

According to the present invention, there is provided a condenser microphone that comprises: a condenser housing having a bottom wall that is formed with a recess defined by a recess-defining wall which has a base wall portion and a peripheral wall portion extending upwardly from the base wall portion; and a condenser disposed in the condenser housing. The condenser includes a spacer, a conductive back plate formed with a first electrode and a plurality of through-holes, and a diaphragm formed with a second electrode, spaced apart from the back plate by the spacer, and cooperating with the back plate and the spacer to confine a variable gap chamber thereamong. The condenser covers the recess in such a manner that the back plate confronts the base wall portion and is connected to the peripheral wall portion so as to form a closed air chamber between the base wall portion and the back plate. The air chamber is in fluid communication with the gap chamber through the through-holes.

BRIEF DESCRIPTION OF THE DRAWINGS

In the drawings which illustrate an embodiment of the invention.

DETAILED DESCRIPTION OF THE PREFERRED EMBODIMENT

Figure 1:
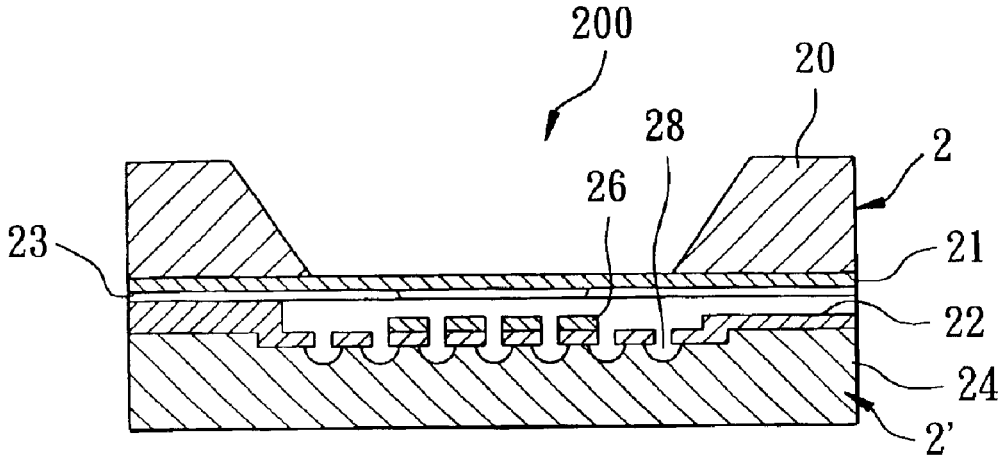
FIG. 1 PRIOR ART
FIG. 1 is a schematic sectional view of a conventional condenser microphone.
Figure 2:
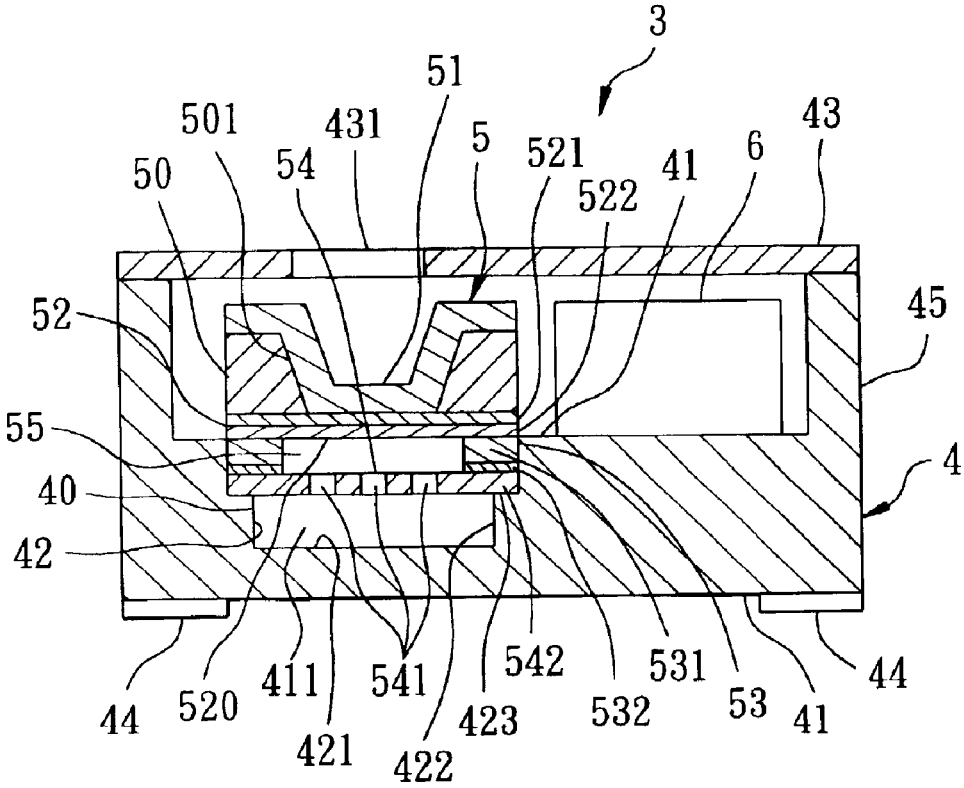
FIG. 2 is a schematic sectional view of a condenser microphone embodying this invention.
Figure 3A:
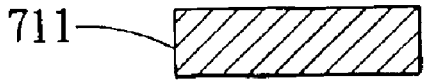
FIGS. 3A to 3I illustrate consecutive steps of making the condenser microphone of FIG. 2 according to a method of this invention.
Figure 3B:
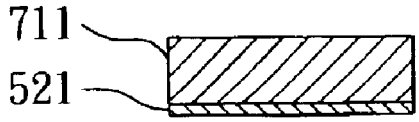
Figure 3C:
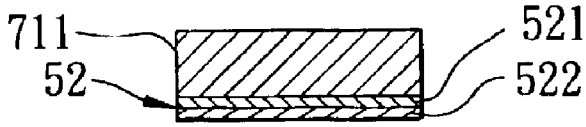
Figure 3D:
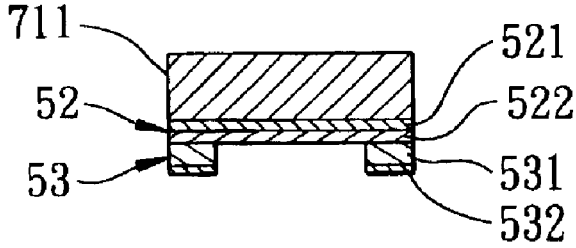
Figure 3E:
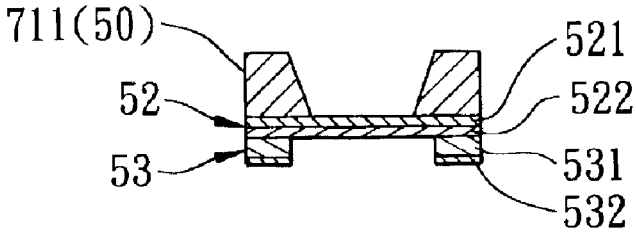
Figure 3F:
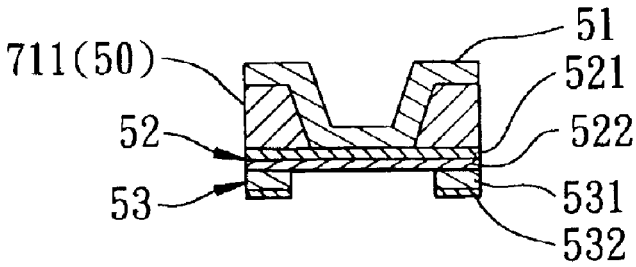
Figure 3G:
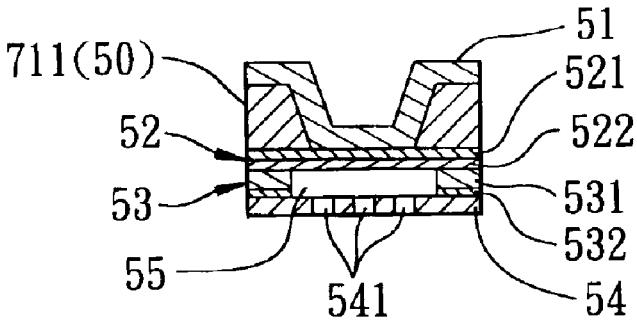
Figure 3H:
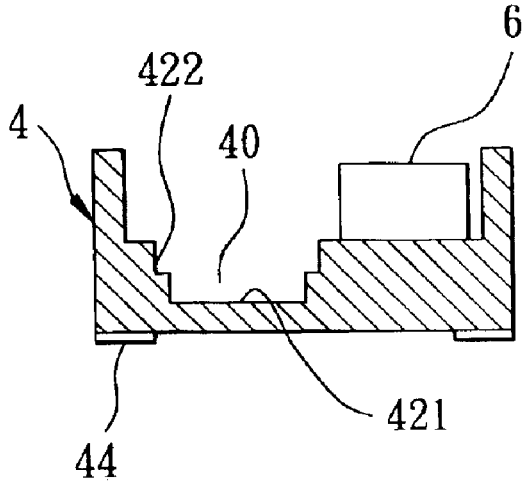
Figure 3I:
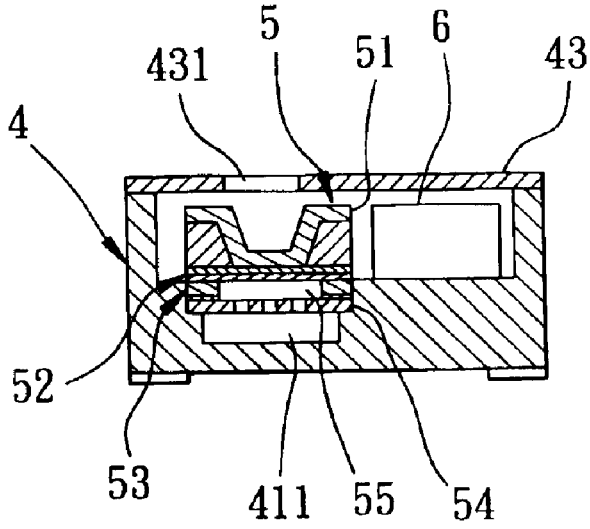

FIG. 2 illustrates a condenser microphone 3 embodying this invention. The condenser microphone 3 includes: a condenser housing 4 having a bottom wall 41 that is formed with a recess 40 defined by a recess-defining wall 42 which has a base wall portion 421 and a peripheral wall portion 422 extending upwardly from the base wall portion 421; and a condenser 5 disposed in the condenser housing 4. The condenser 5 includes a spacer 53, a conductive back plate 54 formed with a first electrode and a plurality of through-holes 541, and a diaphragm 52 formed with a second electrode, spaced apart from the back plate 54 by the spacer 53, and cooperating with the back plate 54 and the spacer 53 to confine a variable gap chamber 55 thereamong. The condenser 5 covers the recess 40 in such a manner that the back plate 54 confronts the base wall portion 421 and is connected to the peripheral wall portion 422 so as to form a closed air chamber 411 between the base wall portion 421 and the back plate 54. The air chamber 411 is in fluid communication with the gap chamber 55 through the through-holes 541 so as to reduce air stream resistance in the gap chamber 55 and so as to prevent breakage of the diaphragm 52 during microphone operation.

The peripheral wall portion 422 of the recess-defining wall 42 is preferably formed with a shoulder 423. The back plate 54 has a peripheral edge portion 542 that is attached to the shoulder 423 and the spacer 53. The spacer 53 is preferably disposed within the recess 40, and is attached to the peripheral wall portion 422 of the recess-defining wall 42.

The condenser housing 4 further has a peripheral wall 45 extending upwardly from the bottom wall 41 and having a top open end that defines a top opening. A top cover 43 covers the top opening, and is formed with an aperture 431 to admit sound waves into the condenser housing 4. The condenser housing 4 is preferably made from a ceramic material. A plurality of electrode contacts 44 are formed on an outer face of the condenser housing 4 so as to permit surface mounting of the condenser microphone 3 to an electronic device (not shown), such as a mobile phone.

The back plate 54 is preferably made from a perorated metal plate, thereby defining the first electrode, and has a thickness ranging from 20 to 100 microns. The through-holes 541 are formed in the metal plate by etching. In other embodiments, the back plate 54 can be made from a ceramic sheet coated with a metal film that defines the first electrode.

A diaphragm supporting frame 50 confines a frame space 501, and is attached to the diaphragm 52. The diaphragm 52 has a central portion 520 exposed from the frame space 501, and includes a silicon dioxide layer 521 formed on the diaphragm supporting frame 50, a silicon nitride layer 522 formed on the silicon dioxide layer 521 and confronting the back plate 54, and an electrode metal layer 51 formed on the silicon dioxide layer 521 at the central portion 520 of the diaphragm 52 and serving as the second electrode. The silicon nitride layer 522 is charged so as to be formed into an electret for providing an external electric field between the diaphragm 52 and the back plate 54.

Preferably, the spacer 53 includes a second silicon dioxide layer 531 formed on the silicon nitride layer 522, and a spacer metal layer 532 formed on the second silicon dioxide layer 531. The back plate 54 is welded to the spacer metal layer 532. In other embodiments, the spacer 53 can be made from a photoresist material, such as polyimide resin, BCB resin, SINR resin, and SU-8 resin. As such, the back plate 54 is attached to the spacer 53 by hot press techniques.

A field effect transistor (FET) 6 is placed in the condenser housing 4, and is electrically connected to the second electrode (i.e., the electrode metal layer 51) of the diaphragm 52 and the electrode contacts 44 so that a change in capacitance of the condenser 5 due to vibration of the diaphragm 52 by an incoming sound wave can be converted into a corresponding electrical signal.

FIGS. 3A to 3I illustrate consecutive steps of making the condenser microphone 3 according to the method of this invention. The method includes the steps of: (a) preparing the condenser housing 4; (b) preparing the condenser 5 by providing a silicon substrate 711 (see FIG. 3A), forming the silicon dioxide layer 521 on the silicon substrate 711 (see FIG. 3B), forming the silicon nitride layer 522 on the silicon dioxide layer 521 (see FIG. 3C), forming the second silicon dioxide layer 531 on the silicon nitride layer 522 (see FIG. 3D), forming the spacer metal layer 532 on the second silicon dioxide layer 531 (see FIG. 3D), back-etching the silicon substrate 711 to form the diaphragm supporting frame 50 (see FIG. 3E), forming the electrode metal layer 51 on the diaphragm supporting frame 50 and the silicon dioxide layer 521 at the central portion 520 of the diaphragm 52 (see FIG. 3F), and attaching the perforated metal plate (i.e., the back plate 54) to the spacer metal layer 532 by welding (see FIG. 3G); (c) placing the FET 6 in the condenser housing 4 (see FIG. 3H); (d) placing the condenser 5 in the condenser housing 4 so as to cover the recess 40 and so as to form the closed air chamber 411 (see FIG. 3I), and electrically connecting the FET 6 to the electrode metal layer 51 and the electrodes 44; and (e) covering the top opening defined by the top open end of the peripheral wall 45 of the condenser housing 4 with the top cover 43 (see FIG. 3I).

The recess 40 in the bottom wall 41 of the condenser housing 4 can be easily formed as compared to the formation of the cavities in the aforesaid microphone back plate of the prior art, and using the back plate 54 and the recess 40 to form the closed air chamber 411 can reduce the size of the condenser microphone 3 to an extent greater than that of the prior art. In addition, the diaphragm 52 is charged to serve as an electret, thereby dispensing with the PTFE electret employed in the prior art.

With the invention thus explained, it is apparent that various modifications and variations can be made without departing from the spirit of the present invention. It is therefore intended that the invention be limited only as recited in the appended claims.

I claim:

1. A condenser microphone comprising: a condenser housing having a bottom wall that is formed with a recess defined by a recess-defining wall which has a base wall portion and a peripheral wall portion extending upwardly from said base wall portion; and a condenser disposed in said condenser housing and including a spacer, a conductive back plate formed with a first electrode and a plurality of through-holes, and a diaphragm formed with a second electrode, spaced apart from said back plate by said spacer, and cooperating with said back plate and said spacer to confine a variable gap chamber thereamong; wherein said condenser covers said recess in such a manner that said back plate confronts said base wall portion and is connected to said peripheral wall portion so as to form a closed air chamber between said base wall portion and said back plate, said air chamber being in fluid communication with said gap chamber through said through-holes.

2. The condenser microphone of claim 1, wherein said peripheral wall portion of said recess-defining wall is formed with a shoulder, said back plate having a peripheral edge portion that is attached to said shoulder and said spacer.

3. The condenser microphone of claim 2, wherein said spacer is disposed within said recess and is attached to said peripheral wall portion of said recess defining-wall.

4. The condenser microphone of claim 1, wherein said back plate is a perforated metal plate.

5. The condenser microphone of claim 4, wherein said metal plate has a thickness ranging from 20 to 100 microns.

6. The condenser microphone of claim 1, wherein said back plate is made from a perforated ceramic sheet coated with a metal film.

7. The condenser microphone of claim 1, wherein said condenser further includes a diaphragm supporting frame confining a frame space, said diaphragm being attached to said diaphragm supporting frame, having a central portion exposed from said frame space, and including a silicon dioxide layer formed on said diaphragm supporting frame, a silicon nitride layer formed on said silicon dioxide layer and confronting said back plate, and an electrode metal layer formed on said silicon dioxide layer at said central portion of said diaphragm and serving as said second electrode, said silicon nitride layer being charged so as to be formed into an electret.

8. The condenser microphone of claim 7, wherein said spacer includes a second silicon dioxide layer formed on said silicon nitride layer, and a spacer metal layer formed on said second silicon dioxide layer, said back plate being welded to said spacer metal layer.

9. A method for making a condenser microphone, comprising the steps of: (a) preparing a condenser housing that has a bottom wall formed with a recess defined by a recess-defining wall which has a base wall portion and a peripheral wall portion extending upwardly from said base wall portion; (b) preparing a condenser having a spacer, a back plate, and a diaphragm, said diaphragm being spaced apart from said back plate by said spacer and cooperating with said back plate and said spacer to define a variable gap chamber thereamong, said back plate being formed with a plurality of through-holes; and (c) placing said condenser in said condenser housing in such a manner that said condenser covers said recess and that said back plate confronts said base wall portion and is connected to said peripheral wall portion so as to form a closed air chamber among said back plate, said peripheral wall portion and said base wall portion, said air chamber being in fluid communication with said gap chamber through said through-holes.

10. The method of claim 9, wherein said peripheral wall portion of said recess-defining wall is formed with a shoulder, said back plate having a peripheral edge portion that is attached to said shoulder and said spacer.

11. The method of claim 10, wherein said back plate is made from a metal plate, said through-holes being formed in said metal plate by etching.

12. The method of claim 11, wherein said spacer includes a spacer metal layer that is welded to said metal plate.

* * * * *